US007581563B2

(12) United States Patent
Smatloch

(10) Patent No.: US 7,581,563 B2
(45) Date of Patent: Sep. 1, 2009

(54) EXHAUST PIPE WITH PROFILED INNER TUBE, AND METHOD OF MAKING AN EXHAUST PIPE

(75) Inventor: Christian Smatloch, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 356 days.

(21) Appl. No.: 11/260,709

(22) Filed: Oct. 27, 2005

(65) Prior Publication Data

US 2006/0096804 A1 May 11, 2006

(30) Foreign Application Priority Data

Nov. 5, 2004 (DE) ..... 10 2004 053 916

(51) Int. Cl.
*F28F 13/06* (2006.01)

(52) U.S. Cl. ..... 138/38; 138/149; 181/212; 181/227; 181/228; 181/247; 181/248

(58) Field of Classification Search ..... 181/212, 181/227, 228, 247, 248, 252, 256; 138/38, 138/149

See application file for complete search history.

(56) References Cited

U.S. PATENT DOCUMENTS 4,690,211 A * 9/1987 Kuwahara et al. ..... 165/177
5,419,127 A * 5/1995 Moore, III ..... 60/322

FOREIGN PATENT DOCUMENTS

| | | | |
|---|---|---|---|
| DE | 29 15 838 | | 10/1980 |
| DE | 34 36 982 | A1 | 4/1986 |
| DE | 37 14 761 | A1 | 11/1988 |
| EP | 0 556 129 | A1 | 8/1993 |
| EP | 0 759 502 | | 4/1998 |
| FR | 2 483 516 | A | 12/1981 |
| JP | 05149132 | A * | 6/1993 |
| JP | 09242538 | | 9/1997 |

* cited by examiner

*Primary Examiner*—Jeffrey Donels
*Assistant Examiner*—Jeremy Luks
(74) *Attorney, Agent, or Firm*—Henry M. Feiereisen; Ursula B. Day

(57) ABSTRACT

An exhaust pipe for an internal combustion engine includes an inner tube carrying a flow of exhaust gas and surrounded by an outer tube, with an insulating layer disposed between the inner tube and the outer tube. The inner tube has at least one region formed with a nub-shaped profile in contact with the flow of exhaust gas.

16 Claims, 1 Drawing Sheet

EXHAUST PIPE WITH PROFILED INNER TUBE, AND METHOD OF MAKING AN EXHAUST PIPE

CROSS-REFERENCES TO RELATED APPLICATIONS

This application claims the priority of German Patent Application, Serial No. 10 2004 053 916.2, filed Nov. 5, 2004, pursuant to 35 U.S.C. 119(a)-(d), the subject matter of which is/are incorporated herein by reference.

BACKGROUND OF THE INVENTION

The present invention relates, in general, to an exhaust pipe for an internal combustion machine, and to a method of making such an exhaust pipe.

It is known to use heat insulation to insulate the exhaust system of an internal combustion engine. Typically, the exhaust system has pipelines made of an inner tube and an outer tube, with the air gap between the inner and outer tubes providing a heat insulating effect. This type of heat insulation is however insufficient to comply with increasingly more stringent regulations and to prevent a demanded limited radiation within the engine space. Although the insulation could be improved by incorporating insulating material, this approach leads to even higher temperature differentials between the inner system and the outer system. Although the resulting different thermal expansions of the involved components could conceivably be compensated through provision of compensators, such as sliding fit, there is still a risk, especially when using fibrous insulating material, that individual fibers are blown out through the gap of the sliding fit by the pulsating pressure of the exhaust gas. This is true for any type of sliding fit for the inner system that lacks gastight separation from the flow of exhaust gas. Furthermore, there is a risk that insulant migrates into the sliding fit and may ultimately cause seizing.

Instead of a sliding fit, it has been proposed to use an expansion bellows which is in direct contact with the flow of exhaust gas, or, as disclosed in European Pat. No. EP 0 759 502 B1, to use a combination of a sliding fit and an expansion bellows, whereby the expansion bellows provides the gas tightness of the inner system. The expansion bellows is hereby surrounded by an air gap. When filling the air gap with insulating material, there is a risk that the insulating material interferes with a movement of the expansion bellows and that the insulating effect of the insulant is adversely affected.

It would therefore be desirable and advantageous to provide an improved exhaust pipe which obviates prior art shortcomings and which is capable to compensate substantially thermal length fluctuations in a simple manner, without requiring the need for a sliding fit or other compensating elements. It would also be desirable and advantageous to provide an improved method of making such an exhaust pipe.

SUMMARY OF THE INVENTION

According to one aspect of the present invention, an exhaust pipe for an internal combustion engine includes an inner tube carrying a flow of exhaust gas and having at least one region formed with a nub-shaped profile in contact with the flow of exhaust gas, an outer tube in spaced-apart surrounding relationship to the inner tube, and an insulating layer disposed between the inner tube and the outer tube.

The present invention thus resolves prior art problems by providing the thin-walled inner tube with a nub-like profile, i.e. a three-dimensional profile, in order to enhance the stiffness of the inner tube. As a result, the wall thickness and thus the weight of the inner tube can be reduced. Thermal length changes can be resiliently absorbed by the multiplicity of nubs, thereby eliminating the need for a sliding fit.

According to another feature of the present invention, the profile may have a wave-like configuration which is defined by wave troughs and wave crests, with the wave troughs and wave crests placed in offset relationship in circumferential direction and/or longitudinal direction. The nubs are hereby formed by the wave troughs and wave crests. Such a configuration can be realized in a sheet metal blank by e.g. a rolling process with suitably profiled pairs of rolls. In other words, the pattern of the profile repeats. The term "wave-like" is used in the disclosure in a generic sense and should not be limited to a sinusoidal course, although a sinusoidal wave profiling is currently preferred. The term "wave-like" should thus be construed to also cover an alternating or oscillating arrangement of elevations (peaks) and depressions (valleys), whereby the wave form may deviate from a sine form, or even cover such configurations like zigzag or trapezoidal profiles.

As the wave form stiffens the inner tube, the wall thickness of the inner tube may be dimensioned very thin and in particular substantially smaller than the wall thickness of the outer tube. Suitably, the amplitude between the wave troughs and wave crests is smaller than or equal to 5 times a wall thickness of the inner tube. The wall thickness of the inner tube may be in a range from 0.05 mm to 1 mm. As a result, the inner tube can have a fine structure and may be made of special steel. Hereby, the special steel may contain, in mass percentage, 10% to 30% of chrome (Cr) and/or 1% to 15% of nickel (Ni). The inner tube is thus able to encapsulate the exhaust-gas flow to separate it in a fluid-tight manner from the insulating layer and the outer tube. As a consequence, the insulating layer is effectively prevented from escaping by the pulsating exhaust gas. At the same time, the acoustic emission of the overall structure, comprised of inner tube, insulating layer and outer tube, is significantly improved so that the exhaust pipe according to the present invention has a better acoustic attenuation.

The profile of the inner tube may extend over the entire length and the entire circumference of the inner tube because manufacture becomes in this case simple. Of course, it is also conceivable to provide a different profile in those regions that are exposed to greater thermal stress as opposed to regions that are exposed to less thermal stress. In particular, the embossment, i.e. the amplitude of the profile in a region subjected to greater thermal stress may be more pronounced because this region has to provide increased compensation of thermal length expansions as opposed to a region that is subject to less thermal stress. A region subjected to greater thermal stress may be a length section and/or a circumferential section of the inner tube. Of course, it is generally also conceivable to profile only part of a region of the inner tube.

Profiling of the inner tube may be realized in many ways. A basic form of the profile involves intersecting waves which are of different size. In other words, embossment to form the waves may vary. In particular, embossments of waves in longitudinal direction may be more pronounced that embossments of waves in circumferential direction, whereby the embossment, i.e. the radially directed dimension, is substantially dependent on the expected thermal length change.

According to another feature of the present invention, the profile may be formed of intersecting waves, with at least one of the intersecting waves having itself an undulating configuration. In this way, the stiffness of the inner tube can be suited to the subsequent shaping process for manufacturing curved exhaust pipes. In general, profiling of the inner tube significantly facilitates the shaping process since the profiled starting material has a greater stiffness than a flat sheet metal blank and allows, due to material reserves, in the shaping tool substantial expansion and compression which would not be possible in flat blanks without experiencing cracks or creases.

According to another aspect of the present invention, a method of making an exhaust pipe includes the steps of profiling a sheet metal blank with wave crests and wave troughs in offset relationship in transverse direction and longitudinal direction, shaping the sheet metal blank into a tubular member or to half-shells, connecting longitudinal edges of the tubular member or half-shells through interlocking engagement or material union to provide gas tightness, enclosing the tubular member with an insulating layer to produce an ensheathed tube, placing the ensheathed tube as an inner tube within an outer tube, jointly bending the outer tube, inner tube and insulating layers, and finally connecting attachment components such as, e.g., a head flange or end flange. In this way, e.g. exhaust manifolds, exhaust gas recirculation lines or also front pipes of an exhaust system can be manufactured.

According to another feature of the present invention, the longitudinal edges may be connected by lock seaming or welding.

According to another feature of the present invention, the insulating layer may be wound about the profiled inner tube.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
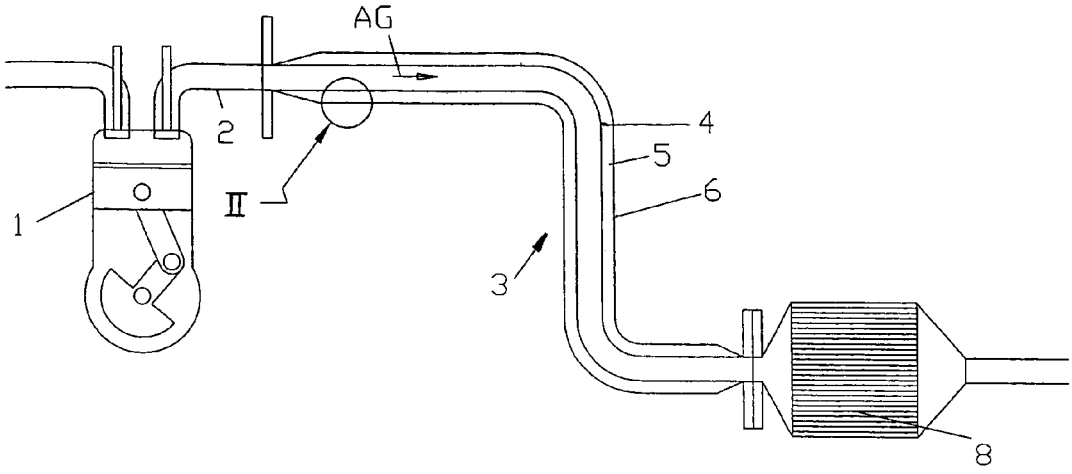
FIG. 1 is a schematic illustration of an exhaust pipe according to the present invention for use in an internal combustion engine.

Throughout all the Figures, same or corresponding elements are generally indicated by same reference numerals. The depicted embodiment is to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of an exhaust pipe according to the present invention, generally designated by reference numeral 3, for use in an internal combustion engine 1 shown symbolically, whereby the exhaust pipe 3 is connected to the internal combustion engine 1 via an exhaust gas outlet 2. The exhaust pipe 3 is comprised of three layers and includes an inner tube 4, a layer 5 of insulating material in surrounding relationship to the inner tube 4, and an outer tube 6 in spaced-apart surrounding relationship to the inner tube 4 and the insulant layer 5. The exhaust pipe 3 conducts an exhaust gas flow AG to a catalytic converter 8.

Figure 2:
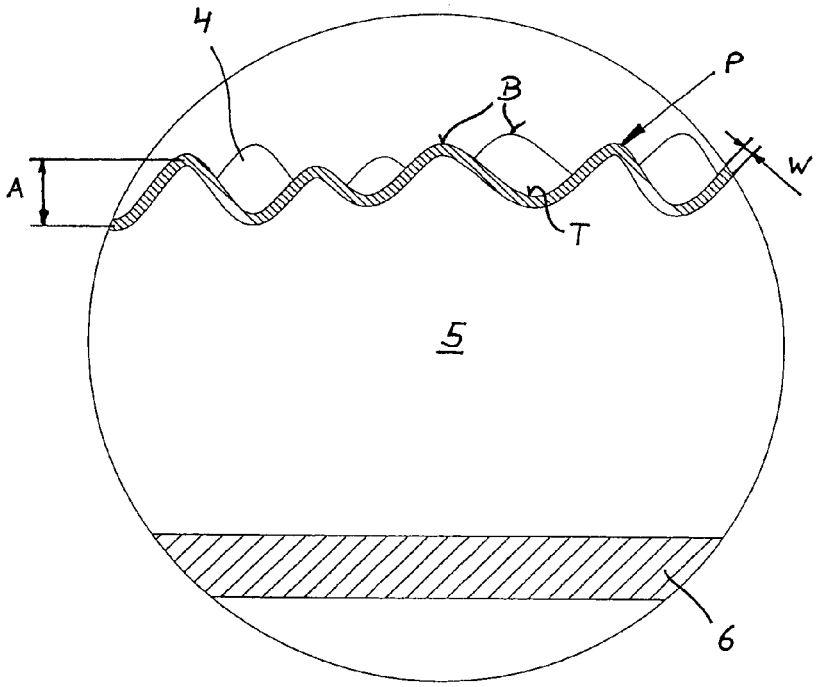
FIG. 2 is an enlarged detailed view of the area encircled in FIG. 1 and marked II.

FIG. 2 shows an enlarged detailed view of the area of the exhaust pipe 3 encircled in FIG. 1 and marked II. For ease of illustration, the insulant layer 5 between the inner tube 4 and the outer tube 6 is not shown in detail here. As shown in FIG. 2 by way of a longitudinal section of the detail II of the exhaust pipe 3, the inner tube 4 has a wall thickness W which is significantly smaller than a wall thickness of the outer tube 6. The inner tube 4 is formed with a nub-like profile P in the form of a wave in longitudinal direction, with the profile P extending also in circumferential direction of the inner tube 4, i.e. in a direction into the drawing plane, as is indicated by wave crests B which are located behind the section plane of FIG. 2, when viewed three-dimensional. In the exemplified embodiment shown in the drawing, wave crests B and wave troughs T immediately follow one another in irregular arrangement. This arrangement extends over the entire inner tube 4 of the exhaust pipe 3 in longitudinal direction as well as in circumferential direction. The amplitude A between the wave crests B and the wave troughs T is hereby smaller than or equal to 5 times the wall thickness W.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. An exhaust pipe for an internal combustion engine, comprising:

an inner tube carrying a flow of exhaust gas, said inner tube having at least one region formed with a nub-shaped profile in contact with the flow of exhaust gas, wherein the profile has a wave-like configuration defined by wave troughs and wave crests, with the wave troughs and wave crests placed in offset relationship in at least one direction selected from the group consisting of circumferential direction and longitudinal direction, wherein an amplitude between the wave troughs and wave crests is smaller than or equal to 5 times a wall thickness of the inner tube;

an outer tube in spaced-apart surrounding relationship to the inner tube; and an insulating layer disposed between the inner tube and the outer tube.

2. The exhaust pipe of claim 1, wherein the inner tube is made of special steel.

3. The exhaust pipe of claim 2, wherein the special steel contains, in mass percentage, 10% to 30% of chrome (Cr).

4. The exhaust pipe of claim 2, wherein the special steel contains, in mass percentage, 1% to 15% of nickel (Ni).

5. The exhaust pipe of claim 1, wherein the profile of the inner tube extends over an entire length and about an entire circumference of the inner tube.

6. The exhaust pipe of claim 1, wherein the inner tube has several of said region which are subjected to different levels of thermal stress, said regions having different profiles.

7. The exhaust pipe of claim 6, wherein the profile of the region subjected to greater thermal stress has an amplitude which is greater than an amplitude of the profile in the region subjected to less thermal stress.

8. The exhaust pipe of claim 1, wherein the profile is formed of intersecting waves which are of different size.

9. The exhaust pipe of claim 1, wherein the profile is formed of intersecting waves, with at least one of the intersecting waves itself having an undulating configuration.

10. The exhaust pipe of claim 1, wherein the nub-shaped profile is formed by juxtaposed peaks and valleys.

11. The exhaust pipe of claim 1, wherein the wall thickness of the inner tube ranges from 0.05 mm to 1 mm.

12. A method of making an exhaust pipe, comprising the steps of:

profiling a sheet metal blank with wave crests and wave troughs in offset relationship in transverse direction and in longitudinal direction and with an amplitude between the wave troughs and wave crests being smaller than or equal to 5 times a wall thickness of the sheet metal blank;

shaping the sheet metal blank into a tubular member or to half-shells;

connecting longitudinal edges of the tubular member or half-shells through interlocking engagement or material union;

enclosing the tubular member with an insulating layer to produce an ensheathed tube;

placing the ensheathed tube as an inner tube within an outer tube;

jointly bending the inner tube and the outer tube to form a structure; and connecting the structure to attachment components.

13. The method of claim 12, wherein the longitudinal edges are connected by lock seaming.

14. The method of claim 12, wherein the longitudinal edges are connected by welding.

15. The method of claim 12, wherein the enclosing step includes the step of winding the insulating layer about the tubular member.

16. The method of claim 12, wherein the wall thickness of the sheet metal blank ranges from 0.05 mm to 1 mm.

* * * * *